United States Patent [19]

Miller

[11] Patent Number: 4,544,208

[45] Date of Patent: Oct. 1, 1985

[54] DEGASIFICATION OF COAL

[75] Inventor: Thomas R. Miller, Waynesburg, Pa.

[73] Assignee: Concoco Inc., Wilmington, Del.

[21] Appl. No.: 633,728

[22] Filed: Jul. 23, 1984

[51] Int. Cl.[4] ..... E21F 5/00

[52] U.S. Cl. ..... 299/12; 166/276; 166/278

[58] Field of Search ..... 299/12; 166/50, 276, 166/278

[56] References Cited

U.S. PATENT DOCUMENTS

| | | | |
|---|---|---|---|
| 2,083,625 | 6/1937 | White | 166/276 |
| 2,652,117 | 9/1953 | Arendt et al. | 166/278 |
| 3,650,564 | 3/1972 | Williamson | 299/11 |
| 3,692,114 | 9/1972 | Murphy, Jr. et al. | 166/278 |
| 4,299,295 | 11/1981 | Gossard | 166/50 |
| 4,471,840 | 9/1984 | Lasseter et al. | 166/280 |

*Primary Examiner*—Stephen J. Novosad
*Assistant Examiner*—Michael Goodwin
*Attorney, Agent, or Firm*—William A. Mikesell, Jr.

[57] ABSTRACT

A coal seam is degasified in advance of its being mined by drilling one or more generally horizontal holes from a working face into the seam, and placing a particulate propping agent into the borehole to maintain its integrity.

3 Claims, No Drawings

DEGASIFICATION OF COAL

BACKGROUND OF THE INVENTION

This invention relates to degasification of coal seams, and more particularly to a procedure for producing and maintaining a generally horizontal gas drainage borehole in a coal seam.

Underground coal mines must always deal with methane gas, which permeates the coal, in order to avoid explosions. The most common way of avoiding an explosive concentration of methane has historically been to dilute the methane with excess air, as by ventilation. More recently various procedures have been both proposed and implemented for draining a significant portion of the methane from the coal seam prior to mining of the seam. In certain instances the methane drainage operation can be so carried out as to result in collection of a useful gaseous methane fuel, in addition to enhancing the safety of any subsequent mining of the drained area.

One approach to methane drainage involves drilling a well from the earth's surface into the coal seam. In U.S. Pat. No. 3,384,416, the well bore is then used to carry out a hydraulic fracturing and propping of the coal seam. U.S. Pat. No. 4,043,395 teaches passing a carbon dioxide-containing fluid down the well bore into contact with the coal, and subsequently recovering the carbon dioxide plus desorbed methane. U.S. Pat. No. 4,245,699 discloses using the well bore to form fissures within the coal seam, as by pressuring and rapid depressuring.

Another approach to methane drainage involves penetrating the coal seam from an underground working face. U.S. Pat. No. 3,650,564 teaches drilling a plurality of parallel holes into the coal seam and then fracturing the seam as by activating explosives in some but not all of the holes, and drawing off methane from the remaining holes. U.S. Pat. No. 4,303,274 discloses degassing a mineable coal seam by drilling horizontal holes into an underlying or overlying seam, and producing gas from the boreholes, such that migration of gas into the mineable seam is reduced. Finally, U.S. Pat. No. 4,321,967 discloses a plastic suction probe which is sealed or cemented into a borehole to allow vacuum pumping of methane therefrom.

SUMMARY OF THE INVENTION

According to the present invention, methane can be drained from a generally horizontal borehole in a coal seam over an extended period of time, thus permitting more complete migration of the gas from the coal mass into the borehole. This is achieved by a procedure of drilling a borehole, flushing the drilled cuttings from the hole, withdrawing the drill rod, and subsequently displacing a particulate propping agent into the borehole through a probe, beginning at a remote end of the borehole, while gradually withdrawing the probe.

DESCRIPTION OF THE INVENTION

Some of the more gassy coal seams tend to be relatively 'soft', i.e. of low mechanical strength, and thus any boreholes which are drilled into the seam, for the purpose of draining the methane, gradually collapse and close off.

The present invention is practiced by first drilling one or more substantially horizontal boreholes into the coal seam, working at the face as shown e.g. in U.S. Pat. No. 3,650,564, noted above. Such drilling is typically accomplished by pushing a string of hollow elongated drill rods, on the front end of which is a drill bit, into the seam. The drilling can be rotary, wherein the drilling machine rotates the entire drill string, or axial, wherein the drilling machine provides a forward thrust on the drill string, and a downhole motor at the forward end of the string rotates the bit.

In either drilling mode, a fluid is generally passed forward through the hollow drill string and through the bit into the borehole. This fluid can serve to cool the drill bit, and to flush the cuttings through the annular space between the drill string and the borehole and thence back to the working face. In the axial drilling mode, this fluid can also provide the motive power for the downhole motor. The fluid can be a gas, such as air, or a liquid, such as water. As is known in the art, such drilling operation is cyclic in that the drill machine head proceeds forward for about the length of one section of drill string, for example 20 feet, and then the drill is stopped, disconnected from the string, the drill machine head is backed off, an additional section of drill rod is attached, and then the forward drilling is again initiated. This procedure has been used to drill boreholes for a horizontal distance of more than 2000 feet from the working face into the coal seam, by utilizing a suitable position monitoring device.

After the borehole has been drilled a suitable distance forward into the seam, the borehole is thoroughly flushed of cuttings by passage of fluid as described earlier. Then the entire drill string and bit are removed from the borehole.

The next step comprises placement of a propping agent in the borehole. Suitable propping agents are granular solids which are resistant to corrosion or solution by formation fluids and which have sufficient compressive strength to withstand destruction under the weight of the formation. The propping agent can be for example glass, plastic or metallic beads, or natural materials such as ground nut shells, seeds, sand or pebbles. The particles are preferably rounded, and of a relatively uniform size consist to prevent packing of the interstices. An especially preferred propping agent is river sand screened to a size range of 8 to 12 or 10 to 20 mesh U.S. Sieve.

The hollow central passageway of one or more drill rods is packed full of the chosen propping agent, and these filled drill rods are pushed into the cleaned borehole as far as possible. No drill bit or downhole motor is used on the drill string during this phase of the procedure, although it is understood that a streamlined annular nose sub can be used on the front end of the string. After the sand-filled rods are pushed as far as possible, a displacement piston is started into the drill string. This piston consists of a solid cylinder sized to travel inside the central passageway of the drill string. The piston is preferably attached to a cable so that the piston can subsequently be retrieved.

After the displacement piston is in place within the drill string, the piston is pushed down the borehole by application of high pressure fluid behind it. As the piston reaches the sand packed within the forward end of the drill string, the drill string is gradually withdrawn from the borehole. In this manner the propping agent is carried to the forward end of the borehole within sections of drill rod, and then the drill rod is effectively removed while the propping agent remains in position.

Once the sand-packed drill rod sections have been emptied, the drill string is pulled from the borehole and the operation is repeated until as much of the borehole is filled with propping agent as is desired.

The final step of the process is to connect the borehole to a gas gathering system. The collected gas can be vented or flared above ground, or can be used as a fuel. If desired, the gas gathering system can be operated under a slight negative pressure to induce more rapid degassing. When the gas production rate has diminished suitably, the mining operation is commenced.

It can be seen that there has been provided a method of forming and preserving degasification boreholes in a coal seam, which method can be effected using equipment which is routinely found underground and has been approved for underground operation. Conventional oilwell fracturing and propping procedures, as have been practiced above-ground, require bulky and specialized equipment which is not suitable for operation underground. The propping agent placement procedure contemplated by the present invention is effected by a pressure behind the displacement piston of as much as 1000 psi or more.

The foregoing description is intended for purposes of illustration rather than by way of limitation. The process is applicable for various types of mining such as longwall or room-and-pillar, and contemplates use of a plurality of packed boreholes.

What is claimed is:

1. A method for degasifying a coal seam comprising:

(a) establishing an underground working face within said seam;

(b) drilling a borehole horizontally away from said face and within said seam utilizing drilling rod means provided with an axial passage;

(c) terminating said drilling step;

(d) removing said drilling rod means from said borehole;

(e) positioning propping agent within a portion of said axial passage of said drilling rod means;

(f) inserting a piston means into said axial passage behind said propping agent;

(g) advancing said drilling rod means containing propping agent and piston means into said borehole; and (h) displacing said propping agent from said drilling rod means by applying fluid pressure into said axial passage against said piston means while concurrently withdrawing said drilling rod means from said borehole.

2. The method of claim 1 wherein said propping agent comprises sand.

3. The method of claim 1 wherein a fluid is passed from said working face by way of said axial passage into a remote location within said borehole, subsequent to said step of terminating, to effect flushing of cuttings from said borehole.

* * * * *